US011845166B2

(12) United States Patent
Moger

(10) Patent No.: US 11,845,166 B2
(45) Date of Patent: Dec. 19, 2023

(54) WRENCH GUARD

(71) Applicant: Chris Moger, West Babylon, NY (US)

(72) Inventor: Chris Moger, West Babylon, NY (US)

( * ) Notice: Subject to any disclaimer, the term of this patent is extended or adjusted under 35 U.S.C. 154(b) by 0 days.

(21) Appl. No.: 18/124,641

(22) Filed: Mar. 22, 2023

(65) Prior Publication Data

US 2023/0302614 A1 Sep. 28, 2023

Related U.S. Application Data

(60) Provisional application No. 63/322,342, filed on Mar. 22, 2022.

(51) Int. Cl.
*B25B 23/16* (2006.01)
*B25G 1/10* (2006.01)

(52) U.S. Cl.
CPC ..... *B25B 23/16* (2013.01); *B25G 1/105* (2013.01)

(58) Field of Classification Search
CPC ..... B25B 23/16; B25G 1/105
USPC ..... D8/28, 27
See application file for complete search history.

(56) References Cited

U.S. PATENT DOCUMENTS 4,811,637 A * 3/1989 McCleary ..... B25B 23/16 81/177.2
5,577,426 A * 11/1996 Eggert ..... B25B 23/12 81/439
5,595,095 A * 1/1997 Hillinger ..... B25B 13/461 81/58.3
5,823,077 A * 10/1998 Macor ..... B25B 13/08 81/177.1
6,003,413 A * 12/1999 Macor ..... B25B 13/462 81/489
6,092,442 A * 7/2000 Macor ..... B25G 1/063 81/177.1
6,418,820 B1 * 7/2002 Lamond ..... B25G 1/105 81/177.1
6,532,846 B2 * 3/2003 Lin ..... B25G 1/005 81/177.2
RE38,778 E * 8/2005 Eggert ..... B25B 23/12 81/439
7,069,822 B1 * 7/2006 Mathis ..... B25G 1/063 81/177.1
8,402,864 B1 * 3/2013 Stephens ..... B25B 23/18 81/177.2
8,671,806 B2 * 3/2014 Lindblom ..... B25G 3/26 81/177.1
D838,154 S * 1/2019 Lilland ..... D8/27
2002/0157505 A1 * 10/2002 Wang ..... B25G 1/105 81/177.1

* cited by examiner

*Primary Examiner* — David B. Thomas
(74) *Attorney, Agent, or Firm* — SHORE IP GROUP, PLLC; Sean R. Wilsusen, Esq.

(57) ABSTRACT

A wrench guard includes a body portion defining a channel. The channel is configured to receive a handle of a wrench. A first sidewall extends from the body portion and defines a first side of the channel. A second sidewall extends from the body portion and defines a second side of the channel. A projection extends from the body portion. The projection is configured to be held between a user's fingers. A magnet is arranged in the channel. The magnet is configured to be magnetically secured to the handle of the wrench to secure the handle of the wrench in the channel.

17 Claims, 10 Drawing Sheets

WRENCH GUARD

CROSS REFERENCE TO RELATED APPLICATION

The present application claims the benefit of and priority to U.S. Provisional Application No. 63/322,342, filed Mar. 22, 2022, the entire content of which is incorporated by reference herein.

FIELD

The present disclosure relates to a guard, and more particularly, to a wrench guard for a user's hand.

BACKGROUND

A wrench (also sometimes referred to as a spanner) is a tool that is employed for providing grip and mechanical advantage in applying torque to turn objects, such as rotary fasteners (e.g., nuts and bolts). Alternatively, a wrench may be employed keeping a rotary fastener from turning. Thus, a wrench can be employed for either tightening or loosening a rotary fastener. As an example, wrenches are often employed in an automotive repair setting, such as for tightening or loosening rotary fasteners employed in an engine of an automobile or other motorized vehicle.

The hand is a complex organ including multiple joints, and various types of ligaments, tendons and nerves. Hand injuries are common and can result from excessive use, degenerative disorders or trauma. Trauma and injuries to the hands and/or fingers can sometimes occur in a work setting in which a user is subjected to repeated use of blunt tools that contact the user's handles and/or fingers. Thus, there is a need for a device for guarding a user's hand from such trauma to the user's hands and fingers.

SUMMARY

Provided in accordance with aspects of the present disclosure is a wrench guard including a body portion defining a channel. The channel is configured to receive a handle of a wrench. A first sidewall extends from the body portion and defines a first side of the channel. A second sidewall extends from the body portion and defines a second side of the channel. A projection extends from the body portion. The projection is configured to be held between a user's fingers. A magnet is arranged in the channel. The magnet is configured to be magnetically secured to the handle of the wrench to secure the handle of the wrench in the channel.

In an aspect of the present disclosure, the body portion defines a substantially flat surface on a side of the body opposite the channel. The substantially flat surface is configured to contact a palm of the user's hand.

In an aspect of the present disclosure, a second magnet is arranged in the body portion opposite the channel. The second magnet is configured to mate with a metal surface to secure the body portion to the metal surface.

In an aspect of the present disclosure, a pad is arranged on the substantially flat surface. The pad is configured to contact the palm of the user's hand to reduce the force of an impact or force applied to the user's hand.

In an aspect of the present disclosure, the projection includes a first projection and a second projection extending from the body portion.

In an aspect of the present disclosure, at least one pad is arranged between the first projection and the second projection. The pad is configured to contact a user's finger.

In an aspect of the present disclosure, the pad includes rubber or plastic.

In an aspect of the present disclosure, the magnet arranged in the channel is a neodymium magnet.

In an aspect of the present disclosure, a magnet is arranged in the body portion opposite the channel. The magnet arranged in the body portion opposite the channel is configured to mate with a metal surface to secure the body portion to the metal surface.

In an aspect of the present disclosure, the magnet arranged in the body portion opposite the channel is a neodymium magnet.

In an aspect of the present disclosure, the body portion defines a square shape.

In an aspect of the present disclosure, the body portion defines a rectangular shape.

In an aspect of the present disclosure, numerous magnets are arranged in the channel. The numerous magnets are spaced apart from each other.

In an aspect of the present disclosure, the magnet(s) arranged in the channel directly contact a wrench when it is arranged in the channel.

In an aspect of the present disclosure, a height of the first sidewall is the same as a height of the second sidewall.

In an aspect of the present disclosure, a length of the first sidewall is the same as a length of the second sidewall.

In an aspect of the present disclosure, a first projection and a second projection extend from the body portion. A height of the first projection is substantially the same as a height of the second projection.

In an aspect of the present disclosure, wherein a surface of the first projection facing away from the body portion defines a curved shape, and a surface of the second projection facing away from the body portion defines a curved shape.

In an aspect of the present disclosure, a surface of the sidewall facing away from the channel defines a curved shape, and a surface of the second sidewall facing away from the channel defines a curved shape.

BRIEF DESCRIPTION OF THE DRAWINGS

Various aspects and features of the present disclosure are described hereinbelow with reference to the drawings wherein.

DETAILED DESCRIPTION

Figure 1:
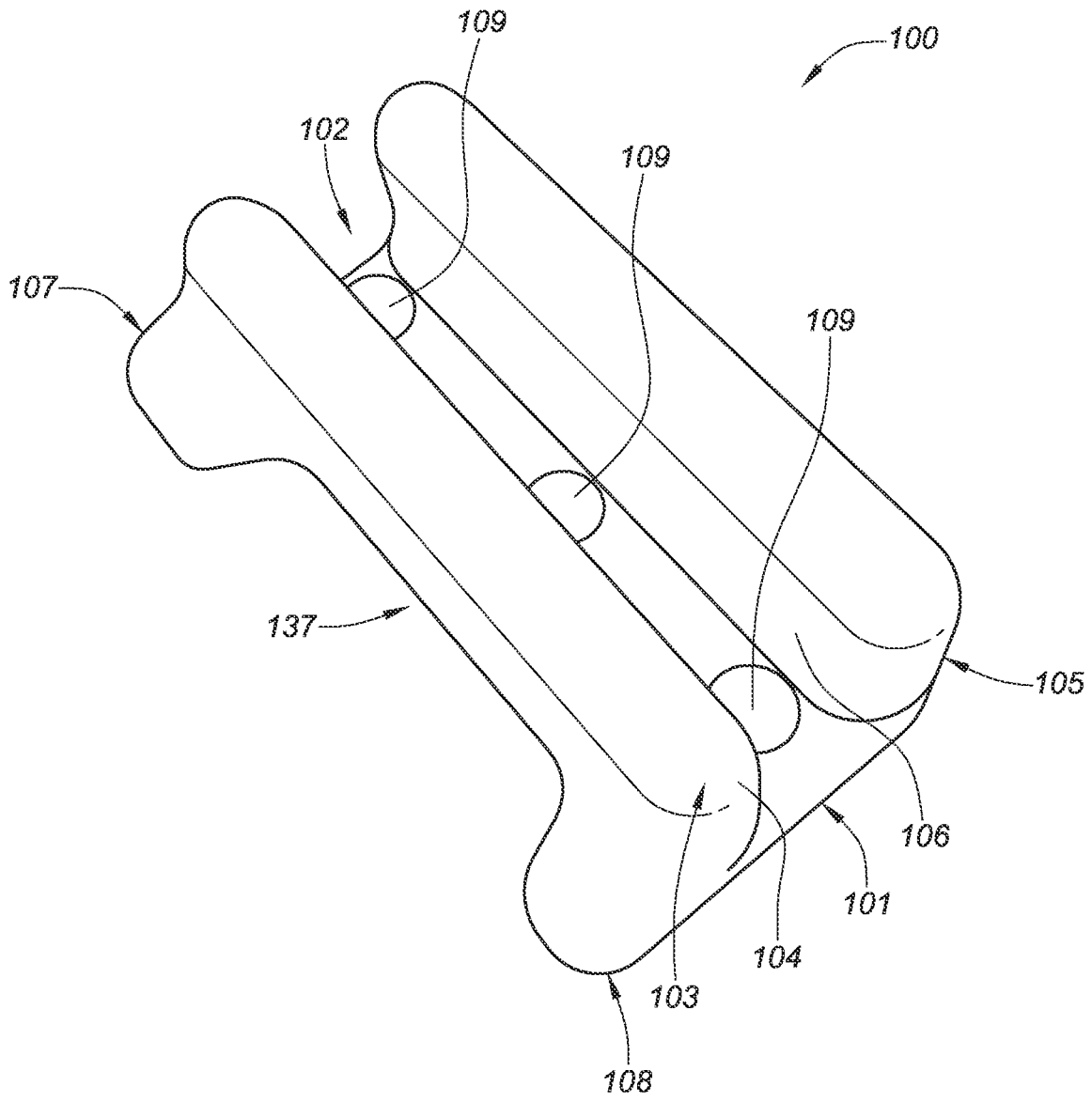
FIG. 1 is a perspective view of a wrench guard according to aspects of the present disclosure.

Descriptions of technical features or aspects of an exemplary configuration of the disclosure should typically be considered as available and applicable to other similar features or aspects in another exemplary configuration of the disclosure. Accordingly, technical features described herein according to one exemplary configuration of the disclosure may be applicable to other exemplary configurations of the disclosure, and thus duplicative descriptions may be omitted herein.

Exemplary configurations of the disclosure will be described more fully below (e.g., with reference to the accompanying drawings). Like reference numerals may refer to like elements throughout the specification and drawings.

The phrases "body" and "body portion" may be used interchangeably herein.

Referring generally to FIGS. 1 to 5B and FIGS. 10 to 12, a wrench guard 100 includes a body portion 101 defining a channel 102. The body portion 101 and any components integrally formed therewith or extending therefrom may be formed of or may include a plastic (e.g., poly lactic acid (PLA)) or a composite material configured to reduced, minimize or eliminate an impact or trauma applied to a user's hand (see, e.g., hand 501 including fingers 502 in FIGS. 5A and 5B) by a tool such as a wrench (see, e.g., wrench 1000 including handle 1001 in FIGS. 10 to 12). The body portion 101 and/or the wrench guard 100 may define a substantially rectangular shape.

The channel 102 extends along an entire length of the wrench guard 100. The channel 102 is configured to securely and removably receive a handle of a wrench. A first sidewall 103 extends from the body portion 101 and defines a first side 104 of the channel 102. A second sidewall 105 extends from the body portion 101 and defines a second side 106 of the channel 102. The first side 104 of the channel 102 faces the second side 106 of the channel 102. The first side 104 of the channel 102 and the second side 106 of the channel 102 may directly contact side surfaces of the wrench to hold the wrench securely in the channel 102 and to prevent longitudinal or lateral movement of the wrench.

At least one projection 107 or 108 extends from the body portion 101. The projection 107 or 108 is configured to be held between a user's fingers. A first projection 107 may be formed at a first side of the wrench guard 100 and a second projection 108 may be formed at a second side of the wrench guard 100. As an example, the wrench guard 100 may be dimensioned such that two fingers of a user fit between the first and second projections 107 and 108. That is, a user's ring and middle finger may fit between the first and second projections 107 and 108 and the user's pointer finger and pinky finger may contact outer surfaces of the first and second projections 107 and 108, respectively. Thus, the first and second projections 107 and 108 allow the user to grip and hold the wrench guard 100 more securely to prevent movement of the wrench guard 100 within the user's hand during use. For example, the first and second projections 107 and 108 may define a channel 137 between the first and second projections 107 and 108 configured to receive the user's fingers.

In an aspect of the present disclosure, at least one magnet 109 is arranged in the channel 102. For example, a series of magnets 109 may be arranged in the channel 102. The magnet(s) 109 is/are configured to be magnetically secured to the handle of the wrench to secure the handle of the wrench in the channel. The magnet(s) 109 facilitate(s) a secure but removable attachment of the wrench with the wrench guard 100. As an example, each magnet 109 may be a neodymium magnet, a samarium cobalt magnet, an alnico magnet, a ferrite magnet, or a flexible rubber magnet. Each magnet 109 may directly contact the wrench or other tool received in channel 102.

Figure 4:
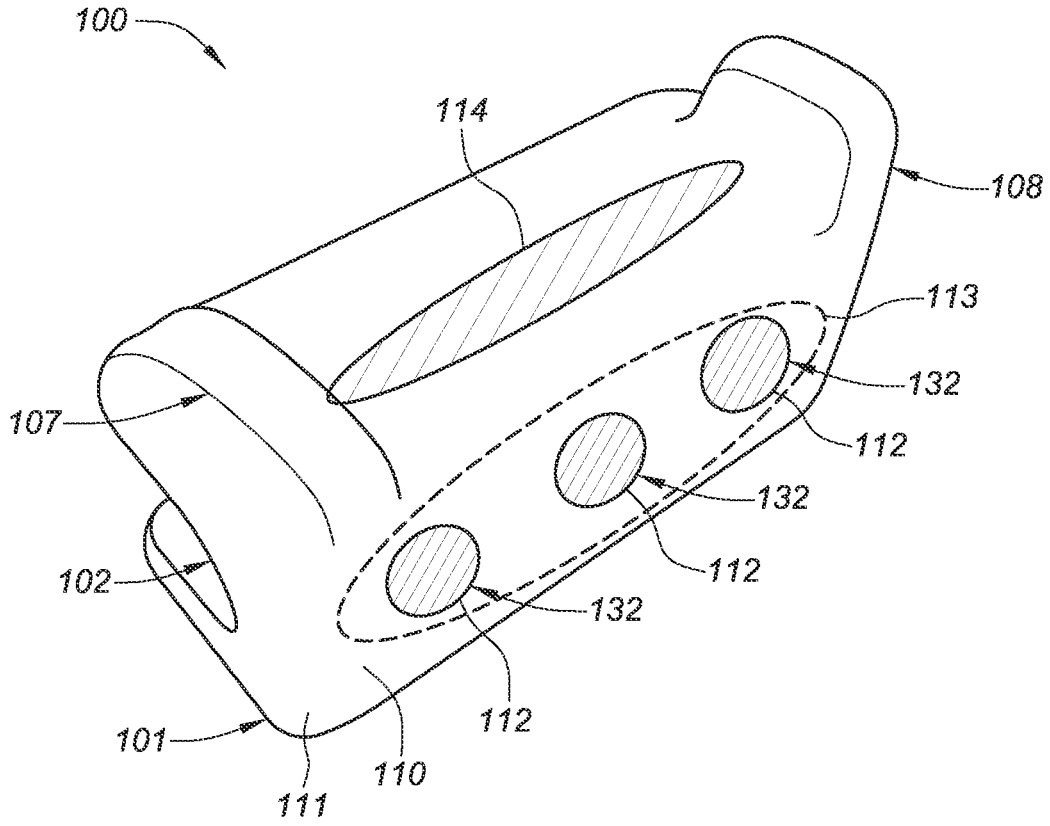
FIG. 4 is a rear, perspective view of the wrench guard of FIG. 1.
Figure 5A:
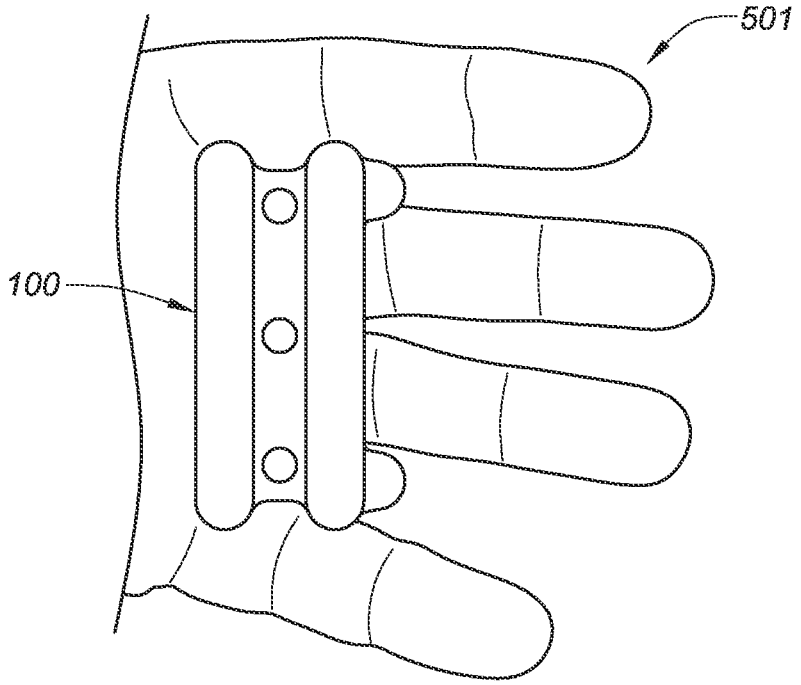
FIG. 5A is a front view of the wrench guard of FIG. 1 positioned in a user's hand.
Figure 5B:
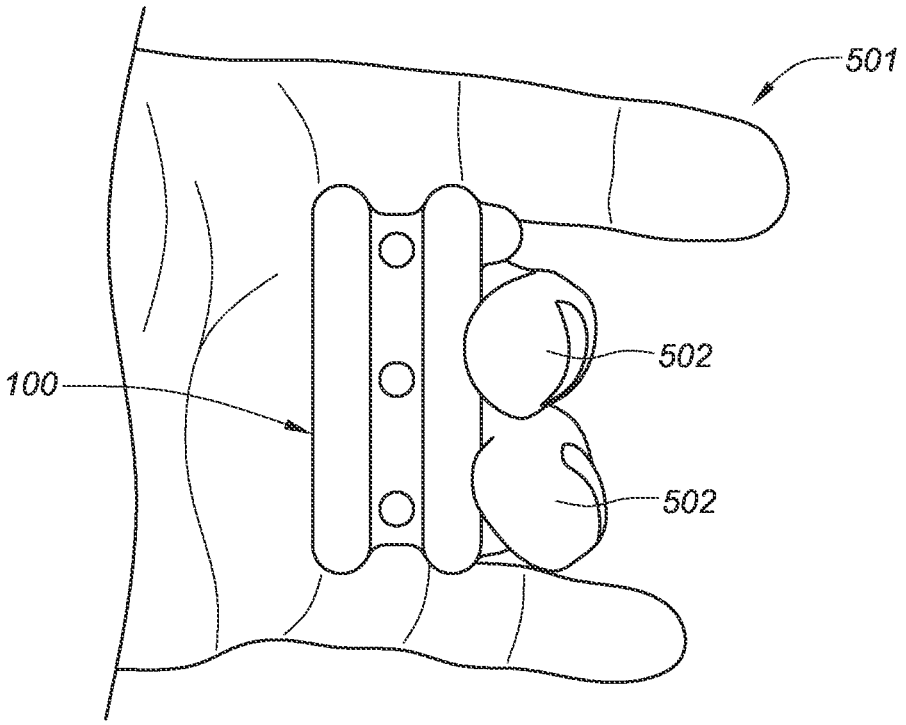
FIG. 5B is a front view of the wrench guard of FIG. 1 positioned in a user's hand with the user's fingers gripping the wrench guard.
Figure 6:
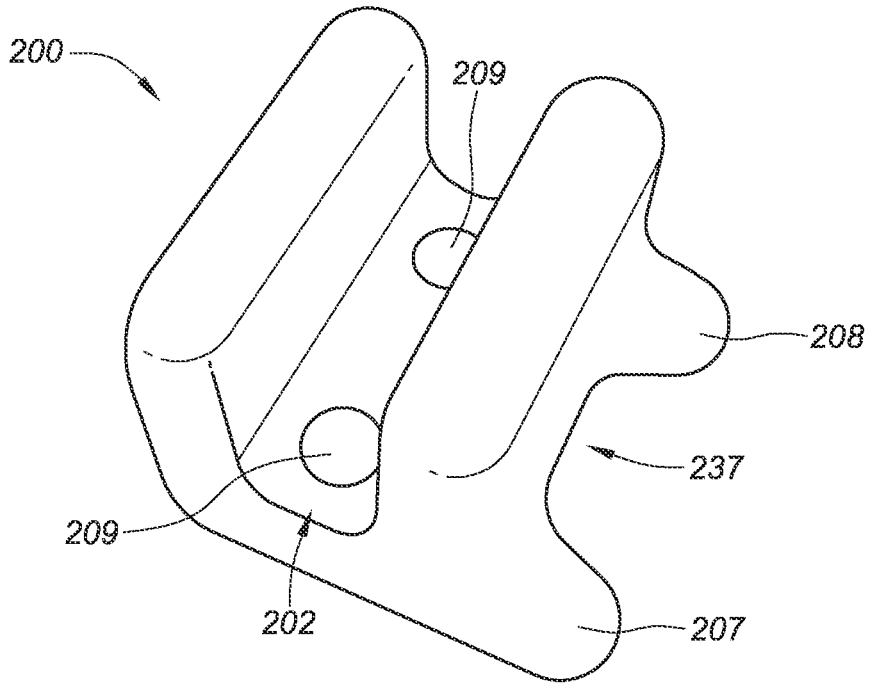
FIG. 6 is perspective view of a wrench guard according to aspects of the present disclosure.
Figure 7:
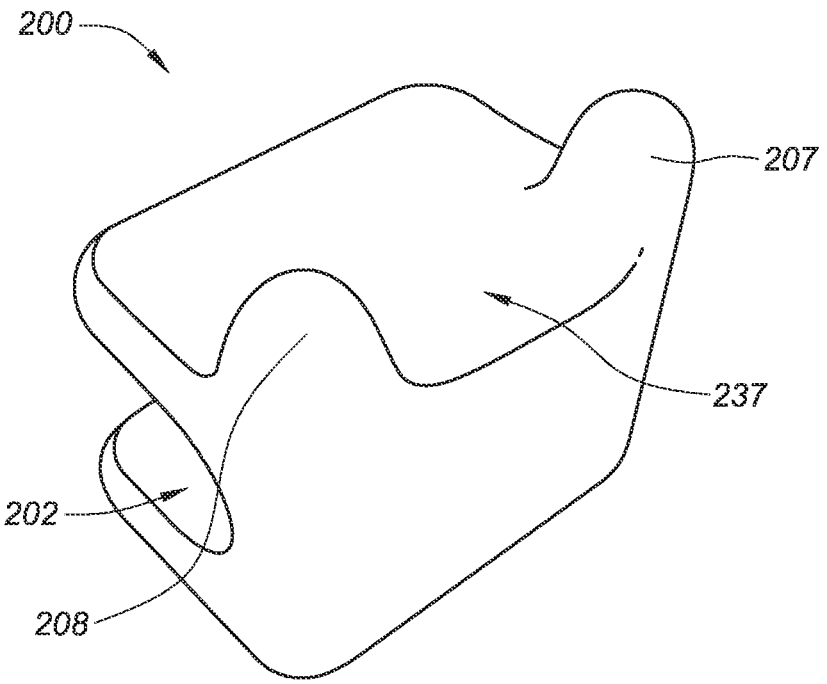
FIG. 7 is a rear, perspective view of the wrench guard of FIG. 6.
Figure 8:
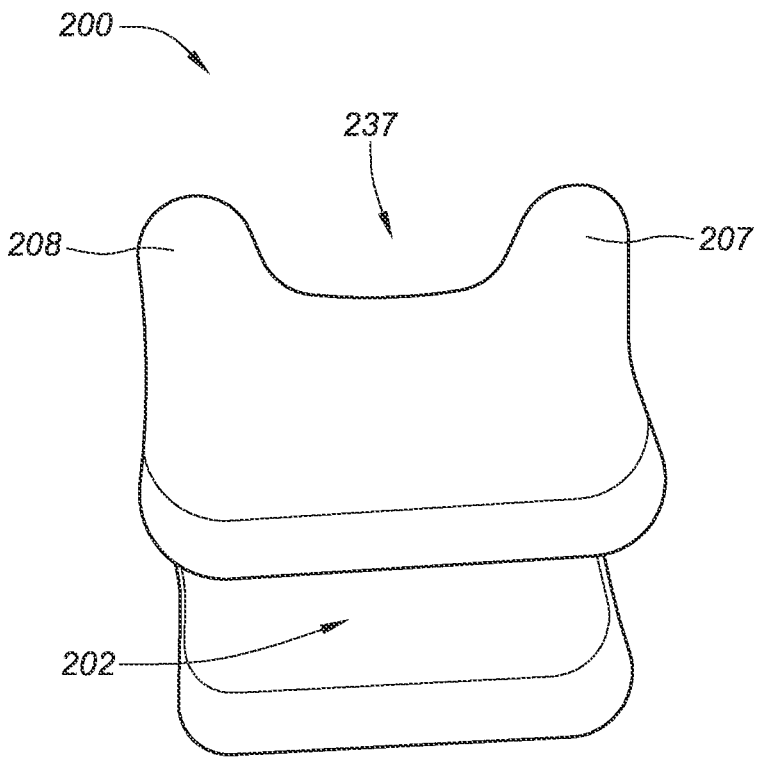
FIG. 8 is a front view of the wrench guard of FIG. 6.
Figure 9:
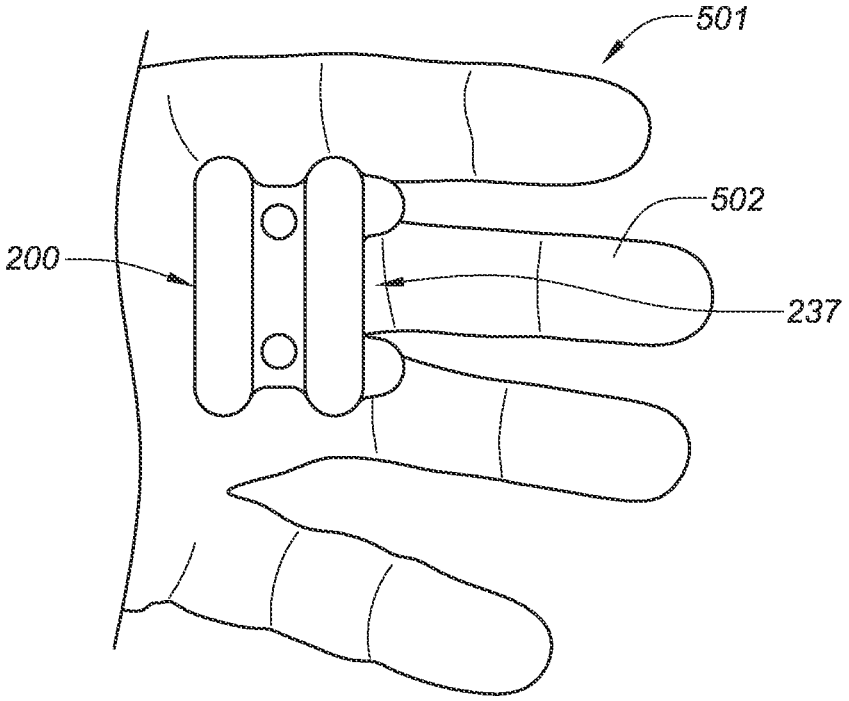
FIG. 9 is a front view of the wrench guard of FIG. 6 positioned in a user's hand.
Figure 10:
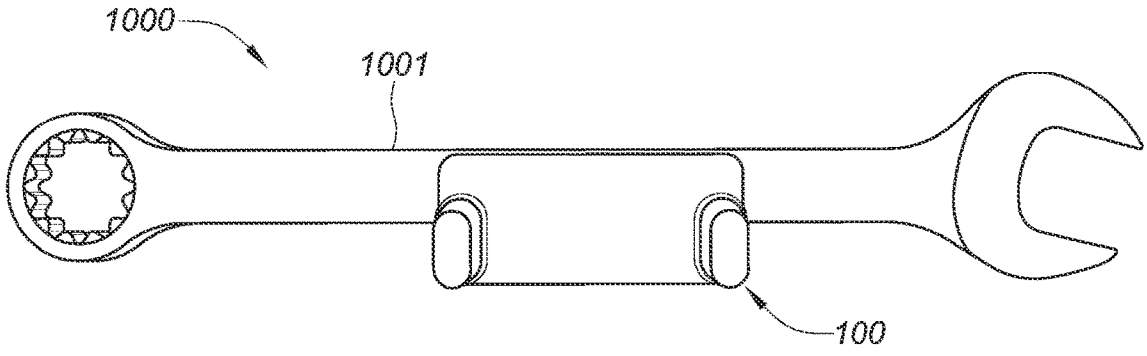
FIG. 10 is a side view of the wrench guard of FIG. 1 with a wrench positioned in a channel of the wrench guard.
Figure 11:
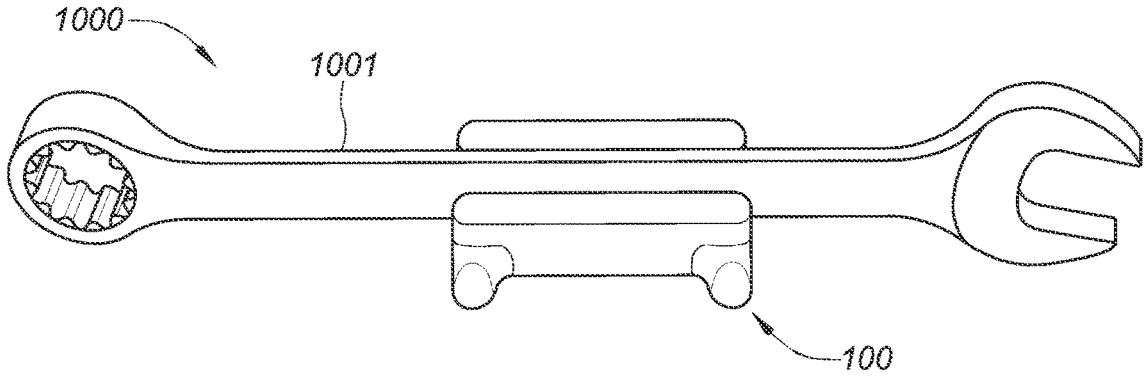
FIG. 11 is an angled, side view of the wrench guard of FIG. 1 with a wrench positioned in a channel of the wrench guard.
Figure 12:
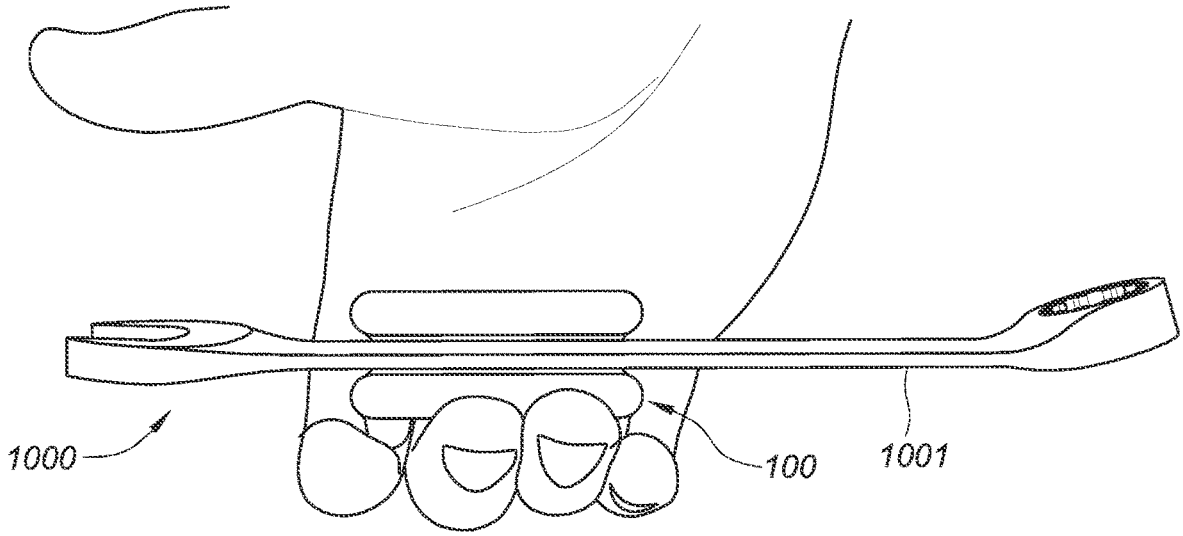
FIG. 12 is a front view of the wrench guard of FIG. 1 with the wrench positioned in the channel of the wrench guard and the wrench guard seated in a user's hand.

Referring particularly to FIG. 4, the body portion 101 may define a flat or substantially flat surface 110 on a side 111 of the body portion 101 opposite the channel 102. The substantially flat surface 110 is configured to contact a palm of the user's hand. The substantially flat surface 110 may be textured or patterned to create a grip and prevent movement of the wrench guard within the user's hand.

In an aspect of the present disclosure, a pad 113 is arranged on the substantially flat surface 110. The pad 113 is configured to contact the palm of the user's hand to reduce the intensity of an impact or force applied to the user's hand. The pad 113 may include a plurality of pads or a single pad. The pad 113 may define, for example, a rectangular or oval shape. The pad 113 provides grip and further reduces, minimizes or eliminates any trauma caused to the user's hand by use of the wrench.

At least one magnet 112 may be arranged in the body portion 101 opposite the channel 102. For example, a series of magnets 112 may be arranged in the body portion 101. The magnet(s) 112 is/are configured to mate with a metal surface to secure the wrench guard 100 to the metal surface. For example, the magnet(s) 112 is/are configured to be used for storing the wrench guard 100 or for temporarily positioning the wrench guard 100 conveniently within reach of the user. As an example, the wrench guard 100 can be magnetically coupled to a metal tool drawer when not in use by employing the magnet(s) 112.

In an aspect of the present disclosure, the pad 113 may be arranged around magnets 112. For example, the pad 113 may include an orifice 132 in a position corresponding with each magnet 112 to expose the corresponding magnet 112. As an example, the pad 113 may define an oval, circular, square, or rectangular shape with a series of orifices 132 arranged to expose surfaces of the magnets 112 so that the magnets 112 can directly contact a metal surface, such as for storage of the wrench guard 100.

Figure 2:
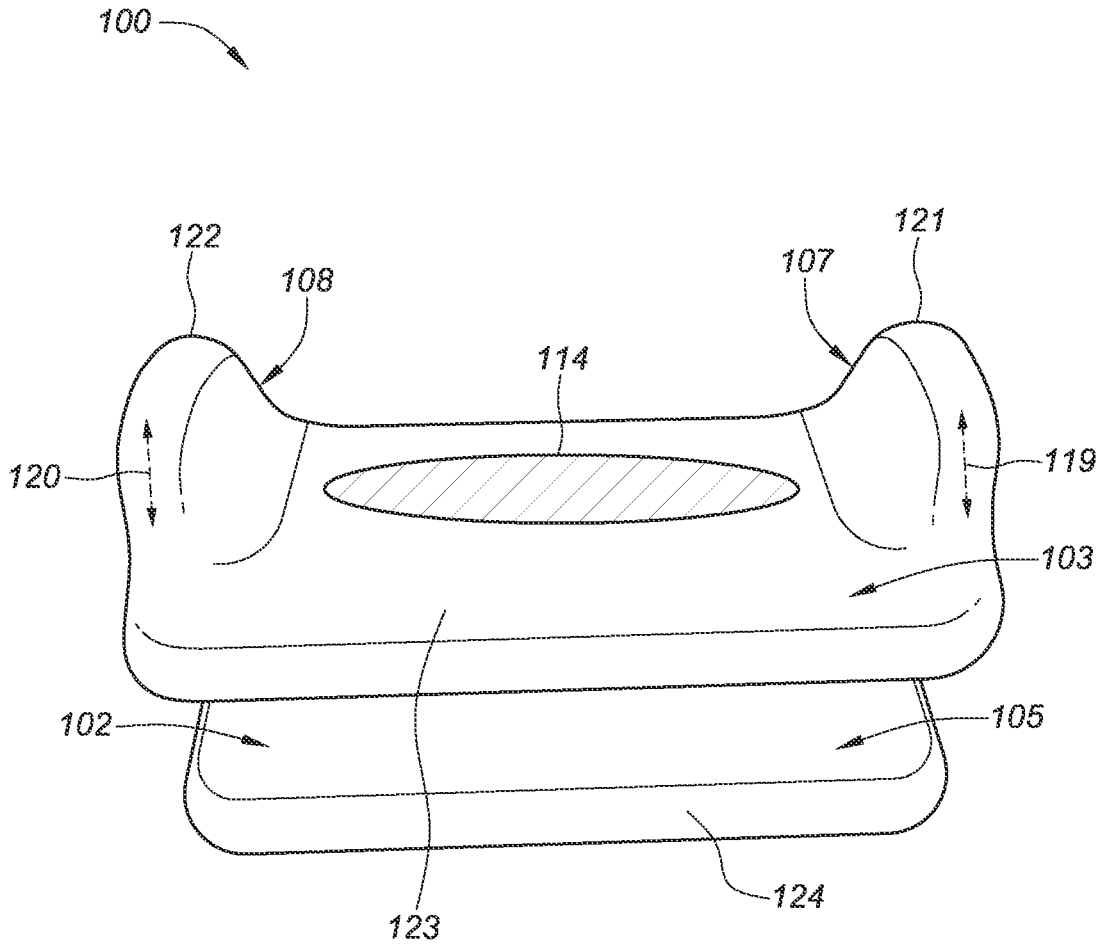
FIG. 2 is a front view of the wrench guard of FIG. 1.
Figure 3:
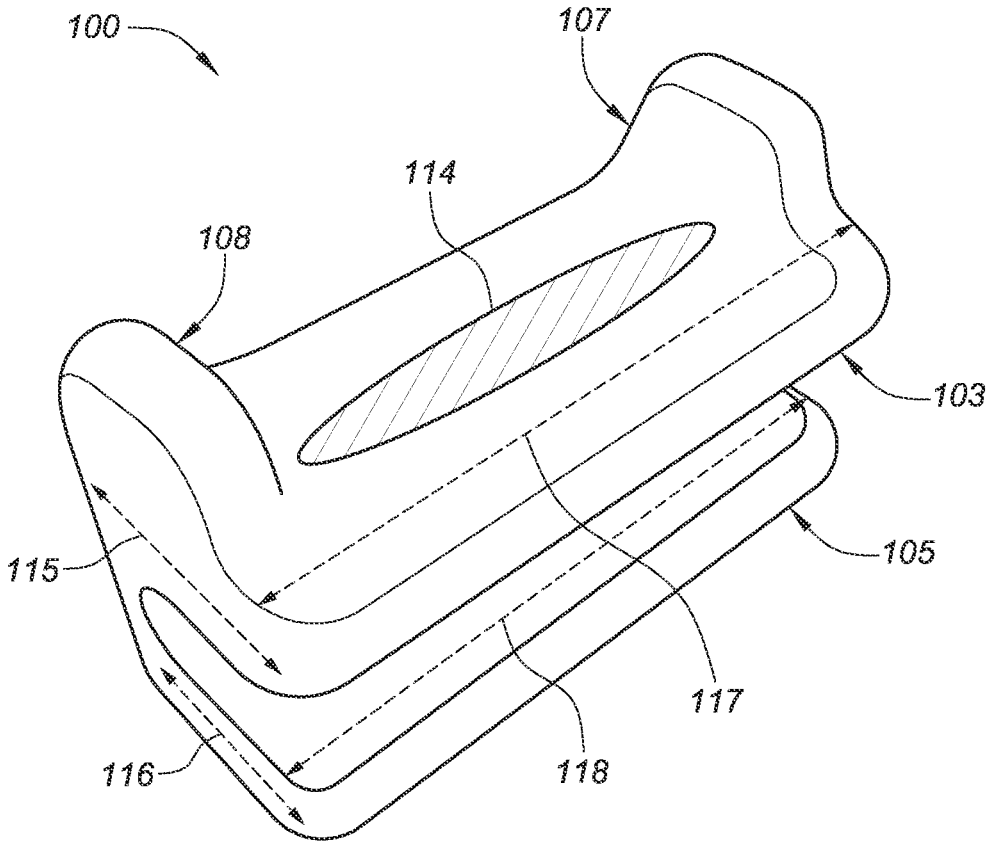
FIG. 3 is a front, perspective view of the wrench guard of FIG. 1.

Referring particularly to FIGS. 2 to 4, at least one pad 114 is arranged between the first projection 107 and the second projection 108. The pad 114 is configured to contact a user's finger. The pad 114 provides grip and protection to the user's fingers. As an example, the pad 114 may define an oval, circular, square, or rectangular shape.

As an example, either of pads 113 or 114 may include a rubber or a plastic material configured to provide grip to the user's hand.

Referring particularly to FIG. 3, a height 115 of the first sidewall 103 is the same as or substantially the same as a height 116 of the second sidewall 105.

In an aspect of the present disclosure, a length 117 of the first sidewall 103 is the same as a length 118 of the second sidewall 105.

Referring particularly to FIG. 2, a height 119 of the first projection 107 is substantially the same as a height 120 of the second projection 108.

In an aspect of the present disclosure, a surface 121 of the first projection 107 facing away from the channel 102 defines a curved shape, and a surface 122 of the second projection 108 facing away from the channel 102 defines a curved shape.

In an aspect of the present disclosure, a surface 123 of the sidewall 103 facing away from the body portion 101 defines a curved shape, and a surface 124 of the second sidewall 105 facing away from the body portion 101 defines a curved shape. The curved surfaces 121, 122, 123, and/or 124 provide increased comfort to a user and prevent any trauma to a user's hand that might result from pointed or squared off surfaces.

A wrench guard 200 described below with reference to FIGS. 6 to 9 has a different shape and dimensions from the wrench guard 100 described above with reference to FIGS. 1 to 5B; however, unless otherwise specified below the wrench guard 200 is configured to include substantially the same features as the wrench guard 100 described above, and thus duplicative descriptions may be omitted below.

Referring to FIGS. 6 to 9, wrench guard 200 defines a substantially square or cuboidal shape and is configured to be secured using three of a user's fingers. For example, projections 207 and 208 are arranged closer together to receive a single user's finger in channel 237 therebetween (see, e.g., FIGS. 6 and 9).

The wrench guard 200 defines a relatively shorter channel 202 configured to receive a wrench or tool removably therein. One or more magnet(s) 209 may be arranged in and spaced apart from each other within channel 202 to securely and removably couple the wrench guard 200 with a wrench or other tool.

In use, the wrench guard 100 or 200 may be employed in an automotive setting in which a pneumatic drill is used to drive a bolt or nut while the wrench is held in a user's hand. Thus, the wrench guard 100 or 200 can reduce, minimize or eliminate a trauma caused by the pneumatic drill to the user's hand when the wrench is held in the user's hand during use of the pneumatic drill.

The wrench guard 100 or 200 operates as a force distribution device that operates according to the formula pressure=force/area. By increasing surface area, the corresponding force applied to a user's hand is reduced. As an example, the wrench guard 100 or 200 can provide a 200-700% (e.g., 500%) increase in surface area that will in-turn reduce an amount of force applied to a user's hand(s) while operating a tool, such as a wrench employed while operating a power tool, such as a pneumatic drill.

While a wrench is described as an example herein, the wrench guard 100 or 200 described herein may be employed for use with tools other than a wrench.

It will be understood that various modifications may be made to the aspects and features disclosed herein. Therefore, the above description should not be construed as limiting, but merely as exemplifications of various aspects and features. Those skilled in the art will envision other modifications within the scope and spirit of the claims appended thereto.

What is claimed is:

1. A wrench guard, comprising:

a body portion defining a channel, the channel configured to receive a handle of a wrench therein;

a first sidewall extending from the body portion and defining a first side of the channel;

a second sidewall extending from the body portion and defining a second side of the channel;

at least one projection extending from the body portion, the at least one projection configured to be held between a user's fingers; and at least one magnet arranged in the channel, the at least one magnet configured to be magnetically secured to the handle of the wrench to secure the handle of the wrench in the channel, wherein the body portion defines a substantially flat surface on a side of the body opposite the channel the substantially flat surface configured to contact a palm of the user's hand.

2. The wrench guard of claim 1, further including at least one pad arranged on the substantially flat surface, the at least one pad configured to contact the palm of the user's hand to reduce the force of an impact or force applied to the user's hand.

3. The wrench guard of claim 1, wherein the at least one projection includes a first projection and a second projection extending from the body portion.

4. The wrench guard of claim 3, further including at least one pad arranged between the first projection and the second projection, the at least one pad configured to contact at least one finger.

5. The wrench guard of claim 4, wherein the at least one pad includes rubber or plastic.

6. The wrench guard of claim 1, wherein the at least one magnet is a neodymium magnet.

7. The wrench guard of claim 1, further including at least one second magnet arranged in the body portion opposite the channel, the at least one second magnet configured to mate with a metal surface to secure the body portion to the metal surface.

8. The wrench guard of claim 7, wherein the at least one second magnet is a neodymium magnet.

9. The wrench guard of claim 1, wherein a first height of the first sidewall is substantially the same as a second height of the second sidewall.

10. The wrench guard of claim 9, wherein a first length of the first sidewall is substantially the same as a second length of the second sidewall.

11. The wrench guard of claim 1, wherein the at least one projection includes a first projection and a second projection extending from the body portion, and wherein a first height of the first projection is substantially the same as a second height of the second projection.

12. The wrench guard of claim 1, wherein the at least one projection includes a first projection and a second projection extending from the channel, and wherein a first surface of the first projection facing away from the channel defines a curved shape, and wherein a second surface of the second projection facing away from the channel defines a curved shape.

13. The wrench guard of claim 1, wherein a first surface of the first sidewall facing away from the body portion defines a curved shape, and wherein a second surface of the second sidewall facing away from the body portion defines a curved shape.

14. A wrench guard, comprising:

a body portion defining a channel, the channel configured to receive a handle of a wrench therein;

a first sidewall extending from the body portion and defining a first side of the channel;

a second sidewall extending from the body portion and defining a second side of the channel;

at least one projection extending from the body portion, the at least one projection configured to be held between a user's fingers; and at least one magnet arranged in the channel, the at least one magnet configured to be magnetically secured to the handle of the wrench to secure the handle of the wrench in the channel, wherein the body portion defines a substantially square shape.

15. The wrench guard of claim 1, wherein the body portion defines a substantially rectangular shape.

16. The wrench guard of claim 1, wherein the at least one magnet includes a plurality of magnets arranged in the channel, wherein the magnets of the plurality of magnets are spaced apart from each other.

17. A wrench guard, comprising:

a body portion defining a channel, the channel configured to receive a handle of a wrench therein;

a first sidewall extending from the body portion and defining a first side of the channel;

a second sidewall extending from the body portion and defining a second side of the channel;

at least one projection extending from the body portion, the at least one projection configured to be held between a user's fingers; and at least one magnet arranged in the channel, the at least one magnet configured to be magnetically secured to the handle of the wrench to secure the handle of the wrench in the channel, wherein the at least one magnet is configured to directly contact the handle of the wrench.

* * * * *